United States Patent [19]

Piotrowski et al.

[11] 4,254,384

[45] Mar. 3, 1981

[54] ELECTRONIC WAVEGUIDE SWITCH

[75] Inventors: Wieslaw S. Piotrowski, Los Angeles; Jorg E. Raue, Rancho Palos Verdes, both of Calif.

[73] Assignee: TRW Inc., Redondo Beach, Calif.

[21] Appl. No.: 848,853

[22] Filed: Nov. 7, 1977

[51] Int. Cl.[2] ..... H01P 1/10; H01P 1/38

[52] U.S. Cl. ..... 333/1.1; 333/102; 333/125

[58] Field of Search ..... 333/1.1, 7 R, 24.1, 333/24.2; 335/4, 5

[56] References Cited

U.S. PATENT DOCUMENTS

| | | | |
|---|---|---|---|
| 3,350,663 | 10/1967 | Siekanowicz et al. | 333/1.1 |
| 3,662,291 | 5/1972 | Cotter | 333/1.1 |

*Primary Examiner*—Paul L. Gensler

*Attorney, Agent, or Firm*—Robert W. Keller; Donald R. Nyhagen; John J. Connors

[57] ABSTRACT

An electronic waveguide switch of a latching type particularly suitable for the microwave and millimeter range. The switch comprises a standard three port housing connected to three waveguides. A switchable junction ferrite is disposed in the center of the housing, the ferrite being of the latching type. A driver ferrite is disposed outside of the housing. All ferrite elements have a substantially cylindrical shape.

16 Claims, 3 Drawing Figures

ELECTRONIC WAVEGUIDE SWITCH

BACKGROUND OF THE INVENTION

This invention relates generally to electronic waveguide switches and particularly relates to a latching switch of the type having a junction ferrite and a driver ferrite.

Electronic waveguide switches are well known in the art. They usually comprise a ferrite junction or switching element disposed in the center of a three port waveguide. The ferrite junction is conventionally provided with a switching coil, the wires extending through the ferrite and the waveguide. Such an electronic latching switch has, for example, been disclosed in a paper by Passaro, et al. entitled "A 35-GHz Latching Switch," which is published in IEEE Transactions on Microwave Theory and Techniques, Vol. MTT-14, No. 12, December 1966, pages 669 through 672.

Electronic latching switches of this type present serious manufacturing problems. Thus the ferrite consists of a three sided body of generally prismatic shape extending towards the three waveguides. It additionally is provided with an impedance matching transformer also extending into each of the three waveguides. The design of such a waveguide presents severe problems because the configuration does not lend itself to analytical design. Hence by cut and try technique various configurations must be evaluated until the proper shape is found which will rotate an electronic signal through +120° and match the impedance of the waveguide to that of the junction.

Additionally the size of the wires used for energizing the switching coil cannot be reduced beyond a certain value. Hence in the millimeter wavelength range (from 30 to 300 GHz) the size of the wire is comparable to that of the waveguide. In other words, the driver portion of the ferrite including the switching coil and its wires cannot be reduced in size beyond a certain value. This in turn limits the highest frequency at which such a switch can be used.

It should also be noted that a particular design which has been evolved by many trials and errors is only suitable for one particular wavelength and cannot easily be scaled up or down for other wavelength ranges.

It is accordingly an object of the present invention to provide an electronic waveguide switch of the latching type suitable for the frequency range between approximately 2 and approximately 100 GHz.

Another object of the present invention is to provide an electronic switch of the type discussed which is amenable to mathematical analysis and hence can readily be scaled up or down to suit any particular wavelength range.

A further object of the present invention is to provide such an electronic switch where the functions of switching and latching are separated from the driving function which actually controls the magnetic properties of the switching ferrite.

SUMMARY OF THE INVENTION

In accordance with the present invention there is provided an electronic waveguide switch of the latching type. The switch is suitable for the microwave range (300 MHz to 30 GHz) and the millimeter ranges (from 30 to 300 GHz). It is particularly suitable for the ranges of a few GHz such as approximately 2 to 100 GHz and more. The switch comprises a standard multi-port waveguide. A switchable junction ferrite element is disposed in the center of the waveguide. A driver ferrite element is disposed substantially outside of the waveguide. Both ferrite elements have a circular diameter. A magnetizing coil is disposed in a cylindrical recess in the driver ferrite. Finally, means are provided for energizing the magnetizing coil thereby to switch and subsequently latch the junction ferrite element. This in turn will rotate at will a signal applied to one of the ports of the waveguide into the second or third port.

For the electronic waveguide switch of the invention to function properly, it is only necessary to provide a single driver ferrite element and a single switchable junction ferrite element. Preferably, however, the switch consists of a dual turnstile construction whereby two driver ferrite elements are disposed opposite each other while two junction ferrite elements are disposed within and centrally of the three port waveguide.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
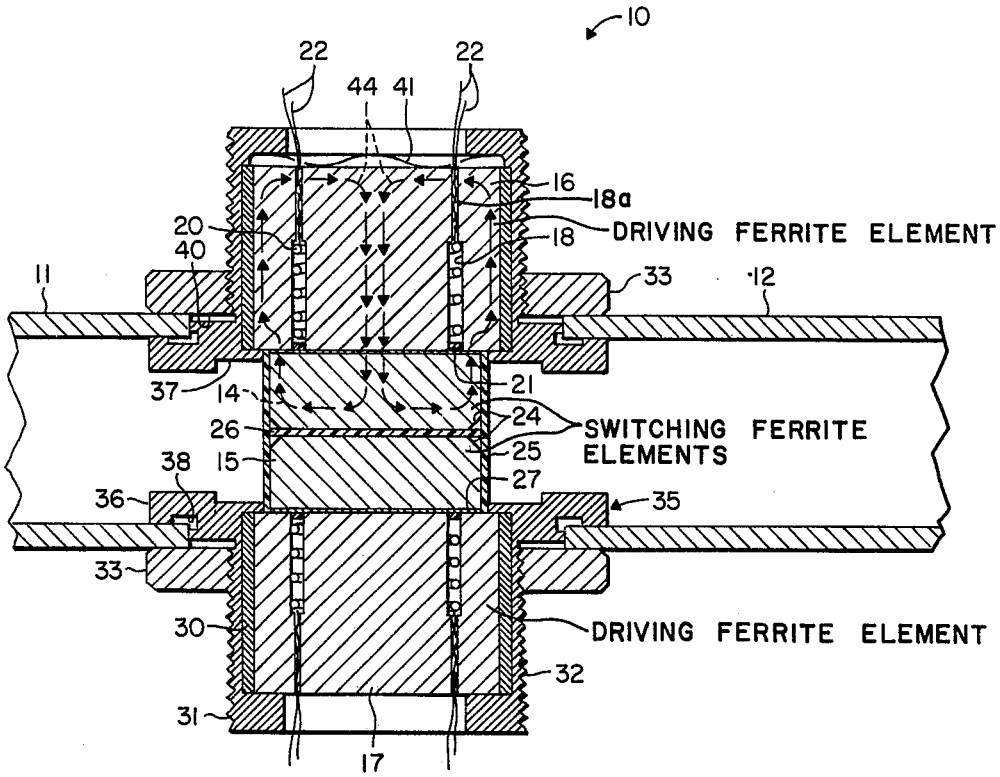
FIG. 1 is a cross-sectional view of a preferred embodiment of the electronic waveguide switch of the invention operable in a dual turnstile mode such cross-section being taken through adjacent angularly separated waveguide ports.

Referring now to the drawings and particularly to FIG. 1, there is illustrated a preferred embodiment of the present invention. The electronic waveguide switch 10 of FIG. 1 includes a housing having three waveguide ports, one being coupled to an input waveguide 11 and the other ports each being respectively coupled to an output waveguide 12. In a conventional manner the switch operates in such a way that an input signal on input waveguide 11 can be directed at will into either one of the two output waveguides, one of which is shown at 12.

This is accomplished by the provision of two junction ferrite elements 14 and 15 which may also be called the switching ferrite elements. Each of the ferrite elements 14 and 15 is substantially of cylindrical form and is disposed in the central region of the three port housing of the switch 10.

The electronic switch of FIG. 1 also includes two driver ferrite elements 16 and 17, each of which is disposed substantially outside of the three port housing. The two driver ferrite elements 16 and 17 of FIG. 1 are also of substantially cylindrical outline and are disposed centrally of the three port waveguide structure 10.

Each of the driver ferrite elements 16 and 17 is provided with an annular recess 18 in which is disposed a magnetic driver having end wires 22. Two slots 18*a* form a passageway from each recess 18 through the element 16 and serve to carry the end wires 22. The wires 22 are connected to a source (not shown) for application of current thereto. The outer end of each annular recess 18 facing the junction ferrite elements 14 and 15 may be provided with a dielectric cover 21 for closing the cylindrical recess 18 and the coil 20.

Preferably the two junction ferrite elements 14 and 15 are chamfered as shown at 24 at their surfaces facing each other. The purpose of this construction is to minimize loss of energy which occurs at those areas because the magnetic circuit does not pass therethrough.

The two junction ferrite elements 14 and 15 are held together by an annular therefor dielectric sleeve 25. They are separated from each other by a dielectric separator or disc 26. This will confine the magnetic circuit to the ferrite elements 14, 16 and to separate it from the magnetic circuit of the elements 15, 17. Additionally conductive septums 27 are disposed between the ferrite elements 14, 16 and 15, 17. The septum 27 acts as a radio frequency barrier and continues a conductive path between the waveguides such as 11 and 12 through 36.

Each of the junction ferrite elements 16 and 17 is surrounded by an annular therefor metallic spacer 30. There is also provided a cap-shaped cover 31 surrounding the spacer 30 and each of the ferrite elements 16 and 17, the cover being externally threaded at 32 and meshing with a nut 33. The nut 33 clamps the waveguides 11 and 12 against an impedance transformer 35 disposed in the interior of the three port waveguide junction. The transformer 35 is generally of disc shape and is disposed internally of the waveguide 11 and 12. Its outer portion has an enlarged thickness 36 which is followed by a reduced portion 37 adjacent to the sleeve 25. The reduced portion 37 may or may not be necessary for matching the impedance of each of the waveguides to the impedance of the waveguide junction. Additionally there may be provided a relief 38 between the impedance transformer 35 and the waveguide such as 11 and another relief 40 between the impedance transformer 35 and the nut 33. This is solely for mechanical reasons to reduce stress and to promote good contact between the transformer 35 and the waveguides 11, 12.

It is essential that there be no magnetic gap between the driver ferrite element 16, septum 27, and the junction ferrite element 14. Such an air gap may change the magnetic properties, interrupt the magnetic loop, and may cause a loss of the latching function. This may, for example, be accomplished by the provision of a spring 41 which bears against the outer surface of the driver ferrite element 16 and the shoulder of the housing 32. It will be understood that other means for spring biasing the ferrite elements may be utilized.

The operation of the device of FIG. 1 will now be explained. The junction ferrite elements 14 and 15 must be high power, low loss devices. They may consist of a ferrite such as a garnet which may have aluminum or gadolinium doping. Hence the junction ferrite element is capable of being latched. That simply means that it will retain its magnetic alignment so as to rotate an incoming signal on input waveguide 11 through an appropriate angle into a selected one of the output waveguides.

On the other hand, the driver ferrite elements 16 and 17 provide high residual flux by means of high retentivity. They may, for example, consist of a lithium zinc ferrite or of a magnesium ferrite or various garnets. Hence when a current pulse is applied to the wires 22 the magnetic field created by the magnetic coil 20 will provide a magnetic loop shown at 44. This in turn will change the alignment of the magnetic dipoles of the junction ferrite element 14 or 15 to circulate an incoming signal into the other output waveguide.

The waveguides 11 and 12 may be made in any conventional manner and may, for example, consist of copper or aluminum and may be silver coated. The housing 32, the spacer 30 as well as the impedance transformer 35 may, for example, consist of copper or aluminum.

The septum 27 may be a thin metallic foil such as gold or gold plated aluminum having a thickness between 0.0001" and 0.0007", depending on the wavelength. Preferably it has a thickness of 0.0004" for the embodiment of FIG. 1. Gold is preferred for the septum 27 because it can be manufactured readily into very thin foils and is malleable to withstand mechanical deformation which may be caused by the spring 41. In general, the septum 27 should be thin enough to provide a good magnetic shield and to reduce RF eddy currents. On the other hand, the foil should be thick enough to form a barrier for the RF energy flowing through the waveguides 11 and 12. The thickness should be about 4 to 5 skin depths.

The spacer 26 and the sleeve 25 should be fabricated from a material characterized by a low loss and a small dielectric constant. For example, it may be made of polytetrafluoroethylene, better known as Teflon.

It should be noted that all essential parts of the junctions, that is ferrite elements 14, 15 and 16, 17 with their associated parts are rotationally symmetrical. Hence the entire waveguide junction is immune to rotation and need not be indexed as is the case with prior art electronic waveguide switches. All that is necessary is to dispose the ferrite elements in the center of the junction which can readily be effected. It will readily be appreciated that the two junction ferrite elements 14 and 15 are securely positioned by the sleeve 25. Hence they form a single compact unit which is self-indexing because it only need be inserted into the central opening between impedance transformers 35. Therefore there is no need to glue or secure, for example, by epoxy resin the waveguide junction. The same is true of the impedance matching transformer 35. Its actual shape will depend on the respective impedances of the waveguides and the junction. It should be noted that the waveguides 11, 12 are standard rectangular waveguides which propagate the $TE_{1,0}$ mode.

The embodiment of the invention of FIG. 1 operates in a dual turnstile mode because there are two driver ferrite elements 16, 17 and two junction ferrite elements 14, 15. This will provide an excellent bandwidth and reduce the impedance matching problem.

The device of FIG. 1 is a high power device and must therefore be capable of dissipating the generated heat. However, this heat is readily conducted away by way of direct thermal paths because the ferrite junction is surrounded by metal parts such as the waveguides, the impedance transformer 35, the spacer 30 and the housing 31. The electric pulse applied to the magnetic coil 20 may have a voltage of say 15 volts and charges or discharges a 47 microfarad capacitor. The pulse duration may be on the order of 0.5 millisecond depending on the pulsing circuit design. Actually the ferrite is capable of switching in the microsecond range.

The device of FIG. 1 will operate from approximately 2 GHz to at least 100 GHz and hence covers the microwave and millimeter wave ranges. It should be noted that the functions of switching and those of circulating as well as latching are separated in the device of the invention. It has been found that the electronic waveguide switch of the invention will operate over a temperature range from −15° F. to +140° F. without significant deterioration of performance.

Reference is now made to Table I which gives the performance data of the device 10.

TABLE 1

| | Measured Data X-Band | Typical Data 2–40 GHz | Typical Data 60–100 GHz |
|---|---|---|---|
| Bandwidth % | 5–10 | 5–10 | 3–6 |
| VSWR (Max) | 1.10:1 | 1.25:1 | 1.25:1 |
| Insertion Loss (Max) dB | 0.15 | 0.3 | 0.5 |
| Isolation (Min) dB | −25 | −20 | −20 |

In the above table, VSWR is the voltage standing wave ratio. The bandwidth is given in percent for:

$$f_2 - f_1/f_0$$

Figure 2:
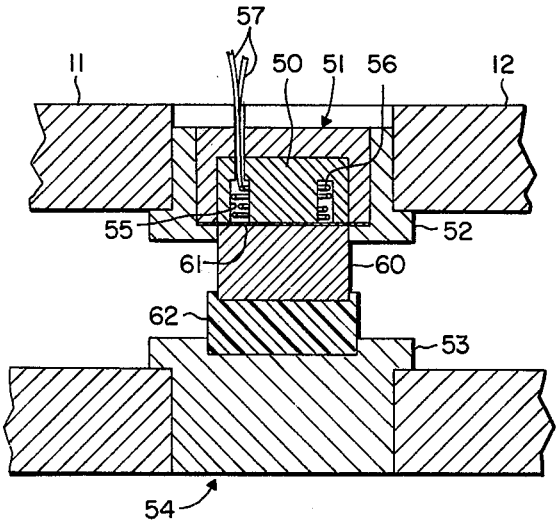
FIG. 2 is a similar cross-sectional view of an electronic waveguide switch in accordance with the present invention which features only a single junction ferrite element and a single driver ferrite element.

Referring now to FIG. 2 there is illustrated another embodiment of the invention which utilizes a single turnstile mode. There are again shown the input and output waveguides 11 and 12. A driver ferrite element 50 is disposed in a metal housing 51, the lower portion 52 of which again forms an impedance transformer. The element 53 forms the other impedance transformer and is integral with a metallic housing 54. The driver ferrite element 50 is again provided with an annular recess 55 for housing therein a magnetic coil 56 having output wires 57. The junction ferrite element 60 is separated from the driver ferrite element 50 by a conductive foil or septum 61. The junction ferrite element 60 extends through the major portion of the junction, that is past the central plane of the waveguide port but not entirely across. It is terminated by a dielectric spacer 62 to fill out the space of the junction.

The junction again is rotationally symetrical and hence the impedance transformers 52, 53, ferrite elements 50, 60 and dielectric spacer 62 are all of cylindrical cross section.

The device of FIG. 2 operates essentially in the same manner as that of FIG. 1 except there is only a single driver ferrite element 50 and a single junction ferrite 60. While the device of FIG. 2 is of simplified construction, it has a narrower bandwidth than that of FIG. 1. There is also an impedance matching problem somewhat more difficult than that of the embodiment of FIG. 1. However, it is possible to operate the electronic waveguide switch of FIG. 2 with a higher magnetic mode of operation.

The driver ferrite element and its magnetic coil have dimensions which cannot be reduced beyond a certain value. For example, at the lower end of the millimeter range the dimensions of the waveguide are comparable to the thickness of the wire. Hence, for the lower millimeter range it may be necessary to provide a driver ferrite which is considerably larger than the junction ferrite element. Such a construction has been illustrated in FIG. 3 to which reference is now made.

Figure 3:
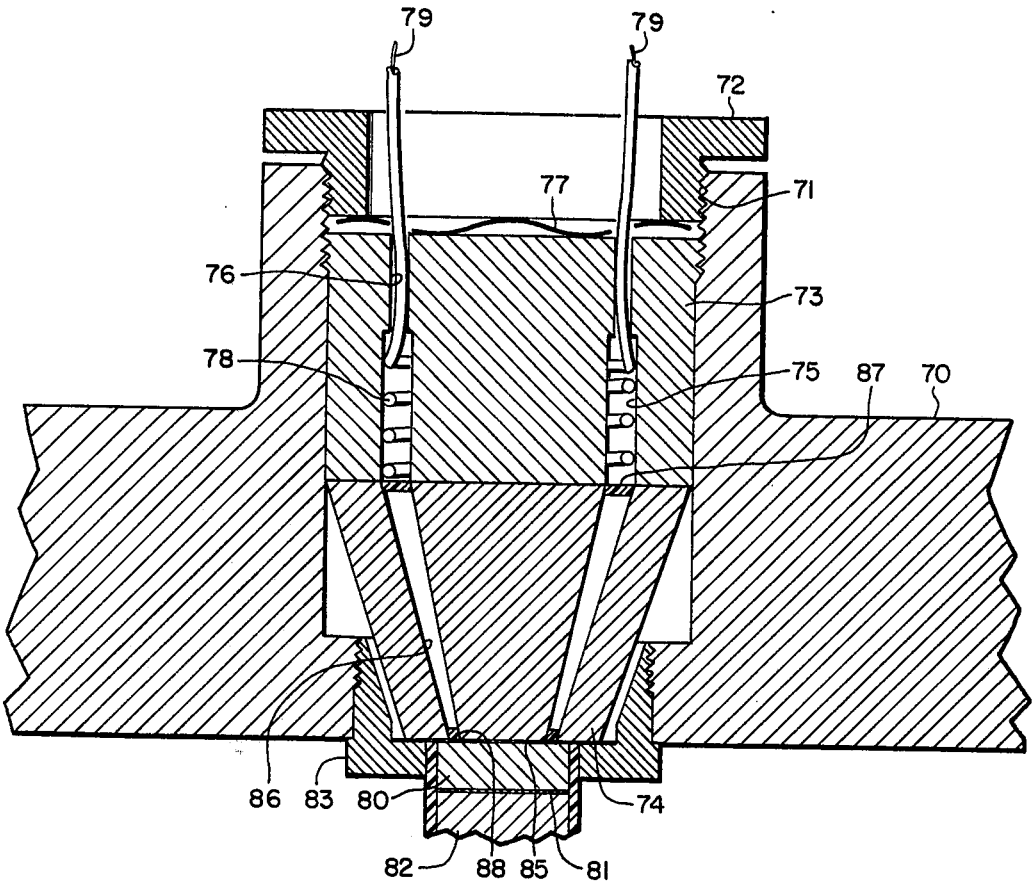
FIG. 3 is a cross-sectional view, parts being broken away of a modified construction of a driver ferrite element suitable for the high end of the wavelength range, that is for the low millimeter range.

FIG. 3 only shows the upper portion of the switch, including a housing 70 of a suitable material. The housing 70 has an upper cylindrical portion which may be externally threaded as shown at 71 to mesh with a cylindrical cover 72 having a central opening.

The driver ferrite element consists of two portions, an upper portion 73 which is cylindrical and a lower portion 74 which is of frusto-conical shape. The upper cylindrical portion 73 is again provided with a cylindrical recess 75 in which is disposed the magnetic coil 78 having output end wires 79 extending through two circular slot openings 76. A spring 77 is provided to press the driver ferrite elements 73 and 74 downwardly. The spring 77 bears against the upper surface of the driver ferrite portion 73 and is pressed down by the cover 72.

The frusto-conical driver ferrite portion 74 which is the lower portion bears against the junction ferrite 80 which is separated by a dielectric spacer 81 from the other junction ferrite element 82 of the dual turnstile mode construction. An impedance matching transformer 83 is screw threaded into the lower portion of the housing 70. The two ferrite elements 80 and 74 are separated from each other by a metallic foil 85 which is preferably a gold foil.

It will now be seen that the flux density developed by the cylindrical driver ferrite portion 73 is increased due to the frusto-conical shape of the other driver ferrite portion 74.

The frusto-conical driver ferrite portion 74 is provided with an internal frusto-conical opening 86 which serves to direct the magnetic loop into the junction ferrite portion 80. The top and bottom of the frusto-conical opening 86 may be closed by some dielectric such as, for example, an epoxy resin as shown at 87 and 88.

The embodiment of FIG. 3 is particularly suitable for operation at frequencies from about 26 to 100 GHz. It will be understood that the embodiment of FIG. 3 otherwise operates essentially like that of FIG. 1.

There has thus been disclosed an electronic waveguide switch which is of particularly simple construction. It is readily amenable to analysis and hence can be simply modified by scaling the model to the desired size. It features a driver ferrite element and magnetizing coil located external to the radio frequency circuit. It provides a large bandwidth, low insertion loss, excellent VSWR ratio and good isolation between the waveguide ports. It is expected to function at frequencies of 100 GHz.

What is claimed is:

1. An electronic waveguide switch comprising:

a housing forming a central region and including at least three waveguide ports;

at least one switchable junction ferrite element disposed in said central region;

at least one driver ferrite element having an annular recess, said ferrite elements having outer perimeters with generally similar shapes; and a magnetizing coil disposed in said annular recess, whereby when a signal is applied to a first of said ports and said coil is energized, said junction ferrite element is caused to switch and hence latch and the signal is rotated to a second port.

2. An electronic waveguide switch as recited in claim 1 wherein said driver ferrite element has a diameter greater than that of said junction ferrite element.

3. An electronic waveguide switch as recited in claim 1 wherein said junction ferrite element extends beyond the center plane of said waveguide.

4. An electronic waveguide switch as recited in claim 1 wherein a dielectric spacer is disposed in said housing adjacent said junction ferrite element to fill substantially the entire space thereof.

5. An electronic waveguide switch as recited in claim 1 wherein said junction and driver elements have a generally circularly shaped outer perimeter.

6. An electronic waveguide switch comprising:

a housing forming a central region and including at least three waveguide ports;

first and second switchable junction ferrite elements disposed in said central region;

first and second driver ferrite elements each having an annular recess;

first and second magnetizing coils disposed in said respective annular recesses;

dielectric means separating said first and second junction elements;

first conductive means disposed between said first junction element and said first driver element; and second conductive means disposed between said second junction element and said second driver element, whereby when a signal is applied to a first of said ports and at least one of said coils is energized, the signal is rotated to a second port.

7. An electronic waveguide switch as recited in claim 6 and further including first and second impedance matching transformers coupling said first and second junction elements, respectively to said ports.

8. An electronic waveguide switch as recited in claim 7 wherein each said transformer includes an annular recess adjacent its associated junction element for impedance matching purposes.

9. An electronic waveguide switch as recited in claim 6 wherein said junction elements include facing chamfered surfaces for concentrating a magnetic field flowing therethrough.

10. An electronic waveguide switch as recited in claim 6 wherein the diameter of said driver elements is greater than that of said junction elements.

11. An electronic waveguide switch as recited in claim 6 wherein said first and second conductive means are disk shaped and have a thickness that is thin enough to minimize the magnetic barrier presented thereby and to reduce signal eddy currents but is thick enough to form a barrier for the signal.

12. An electronic waveguide switch as recited in claim 11 wherein the thickness of said first and second conductive means is between approximately four and approximately five skin depths of the signal current.

13. An electronic waveguide switch as recited in claim 6 and further including spring means for biasing said first driver element toward said first junction element so as to substantially prevent any air gap between elements and the conductive means.

14. An electronic waveguide switch as recited in claim 6 wherein said first and second junction elements are capable of withstanding relatively high power operation and said first and second driver elements are characterized as having a high retentivity.

15. An electronic waveguide switch as recited in claim 6 wherein said junction elements, said driver elements and said conductive means have generally circularly shaped outer perimeters.

16. An electronic waveguide switch as recited in claim 6 wherein the portion of said first and second driver elements proximate said first and second junction elements, respectively, has a frusto conical shape terminating in a surface that has a greater perimeter than that of the adjacent surface of said junction elements.

* * * * *